US011866243B2

(12) United States Patent
Birgersen et al.

(10) Patent No.: US 11,866,243 B2
(45) Date of Patent: Jan. 9, 2024

(54) VACUUM-INSULATED CONTAINER BODY, CONTAINER AND METHODS ASSOCIATED

(71) Applicant: Oyster Thermal AS, Oslo (NO)

(72) Inventors: Torgeir Birgersen, Oslo (NO); Ian Paul Sandmael, Lysaker (NO); Paul Alexander Daniel, Oslo (NO)

(73) Assignee: Oyster Thermal AS, Oslo (NO)

( * ) Notice: Subject to any disclaimer, the term of this patent is extended or adjusted under 35 U.S.C. 154(b) by 0 days.

(21) Appl. No.: 17/776,991

(22) PCT Filed: Nov. 16, 2020

(86) PCT No.: PCT/EP2020/082275
§ 371 (c)(1),
(2) Date: May 13, 2022

(87) PCT Pub. No.: WO2021/094614
PCT Pub. Date: May 20, 2021

(65) Prior Publication Data

US 2022/0388756 A1 Dec. 8, 2022

(30) Foreign Application Priority Data

Nov. 15, 2019 (GB) ..... 1916709
Nov. 15, 2019 (GB) ..... 1916711

(51) Int. Cl.
*B65D 81/38* (2006.01)
*B65D 43/02* (2006.01)

(52) U.S. Cl.
CPC ..... *B65D 81/3818* (2013.01); *B65D 43/0222* (2013.01); *B65D 81/3823* (2013.01);
(Continued)

(58) Field of Classification Search
CPC ..... B65D 81/3818; B65D 81/3813; B65D 81/3823; B65D 43/00; B65D 43/022;
(Continued)

(56) References Cited

U.S. PATENT DOCUMENTS 2,060,155 A 11/1936 Wilhelm
5,345,814 A * 9/1994 Cur ..... G01M 3/227 73/49.3

(Continued)

FOREIGN PATENT DOCUMENTS

GB 525 490 A 8/1940

OTHER PUBLICATIONS

International Search Report and Written Opinion for International Application No. PCT/EP2020/082275, dated Mar. 9, 2021.

*Primary Examiner* — Chun Hoi Cheung
*Assistant Examiner* — Brijesh V. Patel
(74) *Attorney, Agent, or Firm* — Wolf, Greenfield & Sacks, P.C.

(57) ABSTRACT

A vacuum-insulated container (1) comprises a container body (2) and a container lid (3). The container body (2) is formed from an inner body shell (8) and an outer body shell (6), which are both made of a metal material. A core (7) is provided between the inner body (shell 8) and the outer body shell (6), and a seal (11) connects to (flanges 12) of the inner body shell (8) and the outer body shell (6), so as to define an intermediate vacuum space (10) surrounding the core (7). A compressible gasket (17) is provided to protect the seal (11). The lid (103) has two pair of fasteners (122) hingedly connected to opposing sides of the lid (103). Each of the fasteners (122) is releasably connectable to the body (102) whilst the lid is in a closed position with respect to the body.

24 Claims, 9 Drawing Sheets

(52) U.S. Cl.
CPC ..... *B65D 2543/00537* (2013.01); *B65D 2543/00953* (2013.01)

(58) Field of Classification Search
CPC . B65D 2543/00537; B65D 2543/00953; A47J 41/0072; A47J 41/028
USPC ..... 220/592.01–592.28
See application file for complete search history.

(56) References Cited

U.S. PATENT DOCUMENTS

| | | | | |
|---|---|---|---|---|
| 6,244,458 | B1 * | 6/2001 | Frysinger | F25D 3/125 220/592.2 |
| 9,688,454 | B2 * | 6/2017 | Ranade | B32B 27/306 |
| 9,791,205 | B2 * | 10/2017 | Mukherjee | F25D 23/063 |
| 2007/0082099 | A1 | 4/2007 | Kellerstrass | |
| 2011/0290808 | A1 * | 12/2011 | Bai | F25D 23/126 220/592.09 |

* cited by examiner

VACUUM-INSULATED CONTAINER BODY, CONTAINER AND METHODS ASSOCIATED

RELATED APPLICATIONS

This Application is a national stage filing under 35 U.S.C. § 371 of International Patent Application Serial No. PCT/EP2020/082275, filed Nov. 16, 2020, which claims priority to Great Britain application number 1916709.7, filed Nov. 15, 2019 and Great Britain application number 1916711.3, filed Nov. 15, 2019. The entire contents of these applications are incorporated herein by reference in their entirety.

The present disclosure relates to an insulated container, and particularly to a vacuum-insulated container. The disclosure may additionally or alternatively relate to a fastener for a container.

Insulated containers are containers designed to maintain a temperature within the container at a consistent level by preventing transfer of heat into or out of the container.

Box-like insulated containers, often known as coolers or cool boxes, are commonly used within the domestic market. Often, a cooling pack is placed inside the container to keep the temperature low. Such coolers traditionally comprise interior and exterior shells of plastic, with hard insulating foam provided between the shells.

Vacuum-insulated shipping containers are sometimes used within the commercial market for transport of heat-sensitive products, such as fresh produce. These are usually rectangular boxes lined with vacuum-insulated panels along each side of the container. This is achieved either by using individual panels along each wall, or by using one or more flat panels that are folded to conform to the walls.

Vacuum-insulated panels comprise a flexible barrier layer formed from multi-layer metallised foil enclosing a rigid, highly porous core that supports the barrier layer. One technique by which conventional vacuum-insulated panels may be manufactured is by assembling these parts in a low-pressure environment, with the foil barrier layer then being sealed via a heat welding process around all edges of the core to maintain the low internal pressure once the panel is removed from the low-pressure manufacturing environment.

Vacuum-insulated shipping containers offer significantly improved insulation and reduced weight compared to conventional insulated cool boxes. However, the vacuum-insulated panels are very delicate and can be easily perforated, thereby destroying the vacuum. Furthermore, whilst the panels have good insulation properties at their centres, this is much lower along the edges or folds where thermal bridges reduce the insulation.

Cylindrical vacuum-insulated containers, known as vacuum flasks, typically comprise interior and exterior shells of steel or sometimes glass, with a vacuum provided within the shells. Such containers do not include a filler material, with the shells themselves instead providing structural integrity. Smaller vacuum flasks are used domestically for keeping beverages warm or cool, whilst larger vacuum flasks are used for industrial purposes, such as storage of liquefied gases.

Vacuum flasks have very good structural strength, but the use of metal shells results in a thermal bridge at the neck of the flask. Furthermore, as the shells provide the structural integrity, vacuum flasks are available only in cylindrical shapes, restricting the way in which this type of container can be used.

A need exists for an improved vacuum-insulated container.

Viewed from a first aspect, the present invention provides a vacuum-insulated container body, comprising: an inner body shell and an outer body shell, wherein the inner body shell and the outer body shell are each preferably made of a metal material; a core provided between the inner body shell and the outer body shell; and a seal connecting the inner body shell and the outer body shell. The inner body shell, the outer body shell and the seal define an intermediate space surrounding the core, with the sealed volume being at a pressure below atmospheric pressure. Each of the inner body shell and the outer body shell comprises a flange bonded to the seal, and the flanges of the inner body shell and the outer body shell are preferably both in a common plane.

The above configuration provides significant advantages compared to existing vacuum-insulated containers. The use of metal shells, instead of a film body, significantly increases the structural integrity of the container. Furthermore, solid metal walls are impermeable to gas and vapor and therefore do not suffer from film diffusion, increasing the lifetime of the vacuum. The use of flanges in a common plane have been found to provide the most effective sealing.

The intermediate space is preferably a vacuum space. For example, the intermediate space may be at a pressure below 500 mbar, preferably below 100 mbar, more preferably less than 10 mbar.

Each of the inner body shell and the outer body shell is preferably vapour-impermeable and/or gas-impermeable.

One or both of inner and outer body shells may be made from aluminium or an aluminium alloy. The aluminium or aluminium alloy may contain at least 50 wt. % aluminium, optionally at least 75 wt. % aluminium, and further optionally at least 90 wt. % aluminium, further optionally at least 95%, further optionally at least 99 wt. %, and further optionally at least 99.5 wt. %.

One or both of the inner body shell and the outer body shell may have an average thickness of less than 1.5 mm, optionally less than 1.2 mm, further optionally less than 1 mm and further optionally less than 0.8 mm. This is considered relatively thin, at least for aluminium when this is used for at least one of the shells.

One or both of the inner body shell and the outer body shell may have an average thickness of greater than 0.1 mm, optionally greater than 0.2 mm and further optionally greater than 0.4 mm.

One or both of the inner body shell and the outer body shell may have an average thickness of about 0.6 mm The outer body shell may be greater in thickness than the inner body shell. This may save material and weight while still providing a still surprisingly effective and robust container.

One or both of the inner body shell and the outer body shell may comprise a single, homogeneous layer of material. For example, one or both of the inner body shell and the outer body shell may have been formed by a deep drawing process. One or both of the inner body shell and the outer body shell may be self-supporting structures, i.e. able to maintain their shape under their own weight, preferably when separate from the rest of the container components.

One or both of the inner body shell and the outer body shell may comprise a base and a wall. The wall may be connected to the flange by a rounded edge. The wall may encircle or surround the base and the base may be connected to the wall by a rounded edge. The base may be substantially planar and may be substantially rectangular, preferably having a rounded rectangular shape. The wall may have a rounded rectangular cross-section, preferably in a plane parallel to the base. The base may be substantially parallel to the plane of the flanges. The wall may extend in a direction substantially perpendicular to the base.

The core may comprise a porous and/or gas-permeable material. For example, the core may be formed from one of polystyrene foam, polyurethane foam, and silica, such as precipitated silica and fumed silica. Fumed silica is most preferred. The core may comprise a porosity (or void fraction) of greater than 50%, and optionally greater than 75%, and further optionally greater than 85%.

The inner body shell and the outer body shell may be in a spaced-apart relationship. For example, the inner body shell and the outer body shell may be spaced apart by at least 5 mm, and further optionally by at least 10 mm. The inner body shell and the outer body shell may be spaced apart by less than 50 mm, optionally by less than 40 mm, further optionally by less than 30 mm.

The seal may be substantially vapour-impermeable and/or gas-impermeable. The seal may be formed from a flexible material, and is preferably not formed from solid metal. The seal may comprise a metallised foil, and may optionally comprise a multi-layer metallised foil. The metallised foil may comprise one or more layers of metal-coated polymer film. The metal may comprise aluminium.

The seal may be formed substantially in a single plane, and the seal may have been cut from a single sheet of material.

The vacuum-insulated container body may comprise a gasket. The gasket may be mounted to the flanges, optionally with the seal between the gasket and the flange. The gasket may be configured to protect the seal, preferably from puncture.

The gasket may be formed from a non-metal material. The gasket may be formed from a compressible material, optionally from an elastomeric material. The gasket may be formed from a gas-impermeable material. The material is preferably, compressible, elastomeric and gas-impermeable.

The gasket may be configured to deform to a surface so as to provide a gas-impermeable seal. However, gas-impermeability is not essential when the vacuum-insulated container does not need to be sealed in a gas-tight manner.

In a preferred embodiment, the present invention may provide a vacuum insulated container comprising a vacuum-insulated container body as described above and a container lid, preferably wherein the container lid is configured to engage the vacuum-insulated container body.

The container lid may be configured to engage the vacuum-insulated container body to define an internal air volume. The container lid and container body may be configured to engage so as to isolate the internal air volume from an external environment.

The container lid may be a vacuum-insulated container lid.

The container lid may comprise an inner lid shell and an outer lid shell, and a core provided between the inner lid shell and the outer lid shell. The container lid may comprise a seal connecting the inner lid shell and the lid body shell, and the inner lid shell, the outer lid shell and the seal may define an intermediate space surrounding the core, where the sealed volume may be at a pressure below atmospheric pressure. Each of the inner lid shell and the outer lid shell may comprise a flange bonded to the seal, and the flanges of the inner lid shell and the outer lid shell may both being in a common plane. The inner lid shell and the outer lid shell may each be made of a metal material.

The flanges of the lid may be configured to engage the flanges of the vacuum-insulated container body.

The container lid may share a similar construction with the vacuum-insulated container body and may comprise any one or more or all of the features discussed above with respect to the vacuum-insulated container.

One or both of the body and the lid may comprise a reinforcement frame configured to reinforce the flange of the respective outer shell. The flange may be made from a metal and may comprise aluminium or an aluminium alloy, which may be aluminium or an aluminium alloy as described above.

The reinforcement frame of one of the body or the lid, preferably of the lid, may comprise a shield portion, which may be configured to cover an interface between the lid and the body when the lid is in the closed position with respect to the body.

The seal may be formed of flexible material.

Optionally, the seal is not formed of solid metal.

The seal may be formed as a layer less than about 0.3 mm thick, optionally less than 0.25 mm thick, about 0.1 to 0.2 mm thick being an example range in which this thickness lies.

The seal may be formed as a multi-layer construction which includes multiple individual vapour/gas barrier layers, for example of metal such as aluminium, each individual barrier layer optionally being about 100 nanometres or within the range of about 70 to 90 nanometres thick.

A distinction can be made between the vapour/gas barrier layer(s), e.g. aluminium layer(s), within the seal layer construction and any additional layers/thickness designed for, for example, puncture protection.

Such vapour/gas barrier layers may be laminated with polymer layers therebetween.

It is a benefit when each barrier layer is relatively thin otherwise diffusion can adversely occur transversally between the sub layers of the film. Some examples employ a multi-layer film or foil consisting of multiple layers of very thin aluminium (each aluminium layer is only about 100 nanometres thick or slightly less).

Each of these aluminium layers individually may not represent a 100% barrier layer but advantageously and surprisingly the sum of them laminated with polymer layers in between gives a superior barrier protection with minimal thermal transfer across the construction.

The seal may be formed as a layer less than about 50% of the thickness of at least one of the inner and outer body shells, for example less than about 33% of such thickness, about 10% to 50%, 15% to 33% or 15% to 25% or 10% to 17% being examples of where this ratio lies.

A further aspect of the disclosure provides a vacuum-insulated container body, comprising:

- an inner body shell and an outer body shell, wherein the inner body shell and the outer body shell are each made of a metal material;
- a core provided between the inner body shell and the outer body shell; and
- a seal connecting the inner body shell and the outer body shell,
- wherein the inner body shell, the outer body shell and the seal define an intermediate space surrounding the core, the intermediate space being at a pressure below atmospheric pressure; and
- the core comprising the entire or substantially the entire intermediate space and being filled with or acting as an insulating core material.

The intermediate space may be a unitary intermediate space at below atmospheric pressure and entirely enclosing the core as a unitary enclosed volume.

A shield may be provided and associated with the outer shell for shielding the seal, the shield optionally comprising a flange running around a periphery of the outer shell and located at least partially outside a perimeter of the seal.

When a gasket is provided, the shield may run around an outer periphery of the gasket to shield the gasket.

A further aspect of the disclosure provides a vacuum-insulated container body, comprising:

an inner body shell and an outer body shell, wherein the inner body shell and the outer body shell are each made of a metal material;

a core provided between the inner body shell and the outer body shell; and a seal connecting the inner body shell and the outer body shell, wherein the inner body shell, the outer body shell and the seal define an intermediate space surrounding the core, the intermediate space being at a pressure below atmospheric pressure; and wherein each of the inner body shell and the outer body shell comprises a flange bonded to the seal, the seal being a flexible seal comprising a flexible material.

In this case the flanges may lie in a common plane which is substantially perpendicular to a direction in which adjacent walls of the inner and outer body shells extend.

The flexible seal may be planar and may extend directly between the flanges.

A further aspect comprises a vacuum-insulated container comprising:

a vacuum-insulated container body according to any preceding aspect hereof; and a vacuum-insulated container lid configured to engage the container body.

In this case, the vacuum-insulated container lid may comprise:

an inner lid shell and an outer lid shell, wherein the inner lid shell and the outer lid shell are each made of a metal material;

a core provided between the inner lid shell and the outer lid shell; and a seal connecting the inner lid shell and the lid body shell, wherein the inner lid shell, the outer lid shell and the seal define an intermediate space surrounding the core, the intermediate space being at a pressure below atmospheric pressure; and wherein each of the inner lid shell and the outer lid shell comprises a flange bonded to the seal, the flanges of the inner lid shell and the outer lid shell both being in a common plane.

Alternatively, the vacuum-insulated container lid may comprise:

an inner lid shell and an outer lid shell, wherein the inner lid shell and the outer lid shell are each made of a metal material;

a core provided between the inner lid shell and the outer lid shell; and a seal connecting the inner lid shell and the lid body shell, wherein the inner lid shell, the outer lid shell and the seal define an intermediate space surrounding the core, the intermediate space being at a pressure below atmospheric pressure; and wherein each of the inner lid shell and the outer lid shell comprises a flange bonded to the seal, the seal which connects the inner lid shell and outer lid shell being a flexible seal comprising a flexible material.

The container may comprise one or more fastener for releasably connecting the lid to the body, and preferably for maintaining the lid in a closed position with respect to the body. The fastener may be configured to engage one or both of a structural frame of the body and a structural frame of the lid. This prevents the fastener from damaging the flange and/or seal of the lid or body.

In one embodiment, the at least one fastener may comprise at least one pair of fasteners hingedly connected to opposing sides of the lid. Each of the fasteners may be releasably connectable to the body whilst the lid is in a closed position with respect to the body. Each of the fasteners may be configured to reconnectably release from the lid when the lid is rotated about that fastener beyond a predetermined angle with respect to the closed position. Thus, the fasteners may act as both a hinge or as a latch, and furthermore if excessive opening force is applied then the fastener may release the lid to prevent damage to the flanges and/or seals of the body and/or lid.

Whilst this design of fastener is advantageous when applied to a vacuum-insulated container as described, it may be employed for any form of container.

Thus, viewed from a further aspect, the present invention also provides a container comprising a body and a lid, the lid having at least one pair of fasteners hingedly connected to opposing sides of the lid, wherein each of the fasteners is releasably connectable to the body whilst the lid is in a closed position with respect to the body, and wherein each of the fasteners is configured to reconnectably release from the body when the lid is rotated about that fastener beyond a predetermined angle with respect to the closed position.

The predetermined angle of the lid with respect to the closed position may be greater than 80° and less than 135°.

In this aspect the container may be a vacuum-insulated container.

The fasteners may be configured to resist further opening of the lid when the lid reaches the predetermined angle with respect to the closed position. That is to say, a resistance to angular rotation may be below a first threshold when an angle with respect to the closed position is below the predetermined angle, and a resistance to angular rotation may be above a second, higher threshold when an angle with respect to the closed position is equal to the predetermined angle.

Each fastener may comprise a first stop and the lid may comprise a second stop corresponding to each first stop. Respective first and second stops may be configured to engage one another, so as to limit rotation around a hinged connection between the lid and the respective fastener. The rotation may be limited when the angle with respect to the closed position is equal to the predetermined angle.

The stops may cause the respective fastener and the lid to form a lever arm about a fulcrum point. Applying a force to the lever arm may cause the lid to open, when the fastener is not connected to the body. Applying a force to the lever arm may cause the fastener to apply a disconnecting force to a member formed on the body, when the fastener is connected to the body, so as to cause the fasteners to reconnectably release from the body.

The body may comprise at least one pair of deformable members corresponding to the at least one pair of fasteners. Each fastener may be releasably connectable to the respective deformable member.

Each fastener may be configured to reconnectably release from the lid by deforming the respective deformable member when the lid is rotated beyond the predetermined angle with respect to the closed position. For example, each fastener may comprise an engagement member configured to engage the deformable member. The engagement member may be offset from the fulcrum point and rotation about the fulcrum point may cause the engagement member to deform the deformable member, which may cause the engagement member to disconnect from the deformable member. The fastener may be configured such that the fastener releases from the body when the engagement member disconnects from the deformable member.

In one example, each fastener comprises a hinge pin. The fastener may be hingedly connected to the lid by the hinge pin. The hinge pin may be configured to be received by a groove formed in the respective deformable member. Thus, the hinge pin may act as the engagement member. The deforming may then comprise deforming a wall of the hinge pin groove. Alternatively, a pin separate from the hinge may be used to engage with the groove of the deformable member.

Each fastener may comprise means for securing the engagement member to the deformable member, in particular by holding the engagement member within the groove. The means for securing may be configured such that the fastener releases from the body when the engagement member disconnects from the deformable member.

In one example, each fastener comprises a lock pin configured to releasably connect to the body, and preferably to the respective deformable member. The lock pin may be configured to connect to the deformable member by deforming the respective deformable member. The lock pin may be received by a groove in the deformable member when the fastener is connected to the body. The body may comprise a stop to prevent movement of the lock pin in one direction. The stop pin may act as the fulcrum discussed above.

The lid and the body may each comprise a compressible gasket. The compressible gaskets may be configured to engage one another when the lid is in the closed position. The fasteners may be configured to compress the gaskets against one another when connected to the body.

The predetermined angle of the lid with respect to the closed position may be greater than 80°, and may optionally be greater than 90°. The predetermined angle of the lid with respect to the closed position may be less than 180°, and optionally less than 135°.

As discussed above, the container may be a vacuum-insulated container and either or both of the lid and the body may optionally comprise any one or more or all of the features of the lid and body discussed above with respect to the first aspect or other aspects hereof.

Viewed from a further aspect, the present invention provides a method of manufacturing a vacuum-insulated container component, comprising: forming an inner shell and an outer shell from a metal material, such that each of the inner shell and the outer shell comprises a flange; assembling the inner shell and the outer shell around a core such that the flanges of the inner shell and the outer shell are both in a common plane; and bonding a seal to the flanges of each of the inner shell and the outer shell, so as to form an intermediate space surrounding the core.

In one embodiment, the method may further comprise evacuating the intermediate space to a pressure below atmospheric pressure after forming. For example, a gas within the intermediate space may be evacuated via a hole formed in the seal or in one of the inner shell and the outer shell. The method may further comprise sealing the hole after evacuating the gas.

This is the current method. It is also feasible to vacuum through the entire 'ring' opening between the two flanges and then apply the barrier film after the target pressure is reached.

In another embodiment, the intermediate space surrounding the core may be formed at a pressure below atmospheric pressure. For example, after assembling the inner shell and the outer shell around a core and before bonding the seal to the flanges, the method may comprise applying a pressure below atmospheric pressure to the intermediate space, such as by subjecting the gap between the flanges of the inner and outer shells to the pressure below atmospheric pressure. Alternatively, the bonding of the seal to the flanges may be performed within an environment at a pressure below atmospheric pressure.

The seal may be bonded to the flanges by an adhesive, which may be a pressure and/or heat reactive adhesive.

Optionally, one or both of the inner shell and the outer shell may be formed by a deep drawing process.

The container component may be a lid of a container or may be a body of a container and may optionally comprise any one or more or all of the features of the lid and body discussed above with respect to the earlier aspects hereof The method may further comprise mounting at least one pair of fasteners to the lid. Each of the fasteners may comprise any one or more or all of the features of the fastener discussed above with respect to the earlier aspects hereof.

Viewed from a further aspect, the present invention provides a method of using a container comprising a body and a lid, the method comprising: connecting the lid to the body in a closed position using at least one pair of fasteners hingedly connected to opposing sides of the lid; releasing a first fastener of each pair of fasteners on a first side of the lid; opening the container to a predetermined angle with respect to the closed position by rotating the lid about a second fastener of each pair of fasteners on a second side of the lid; and rotating the lid beyond the predetermined angle with respect to the closed position, thereby causing the second fastener of each pair of fasteners to release from the body.

The method may further comprise re-connecting the lid to the body using the at least one pair of fasteners after causing the second fastener of each pair of fasteners to release from the body.

The container may comprise any one or more or all of the features of the containers discussed above with respect to the earlier aspects hereof.

Certain preferred embodiments of the present invention will now be described in greater detail, by way of example only and with reference to the accompanying drawings, in which:

FIGS. 1*a* and 1*b* show a first embodiment of a vacuum-insulated container comprising a body and a lid in a closed position and an open configuration, respectively;

Figure 7:
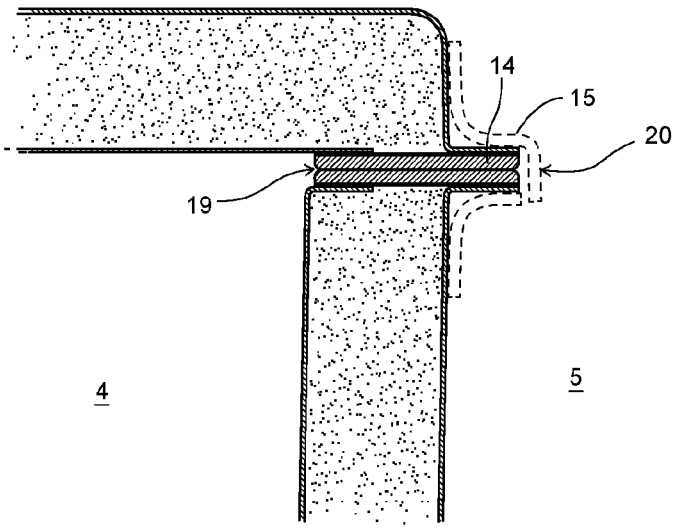
Figure 7B:
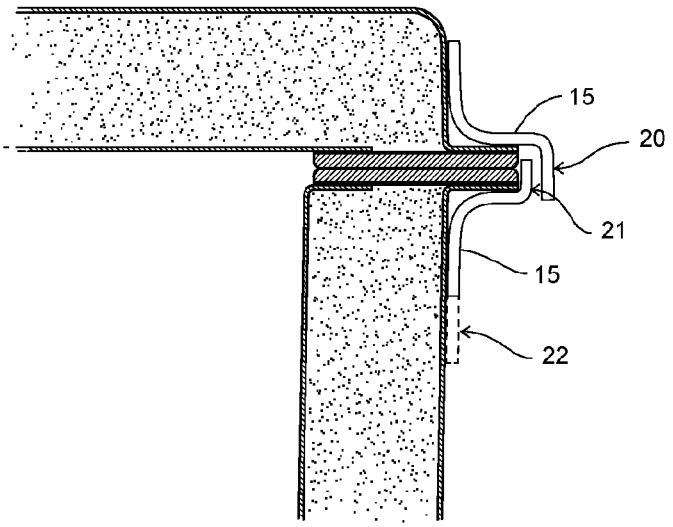
Figure 7C:
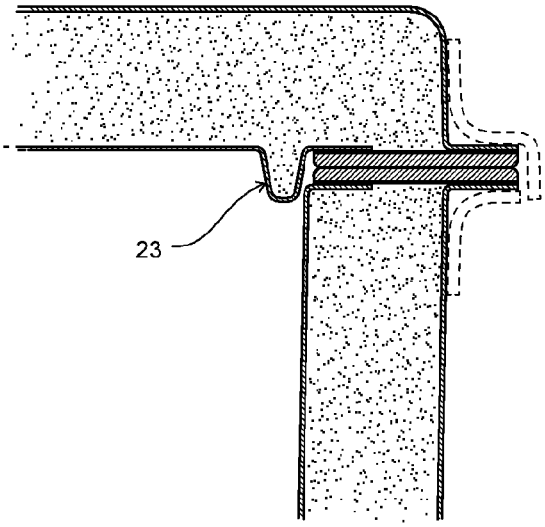
Figure 8:
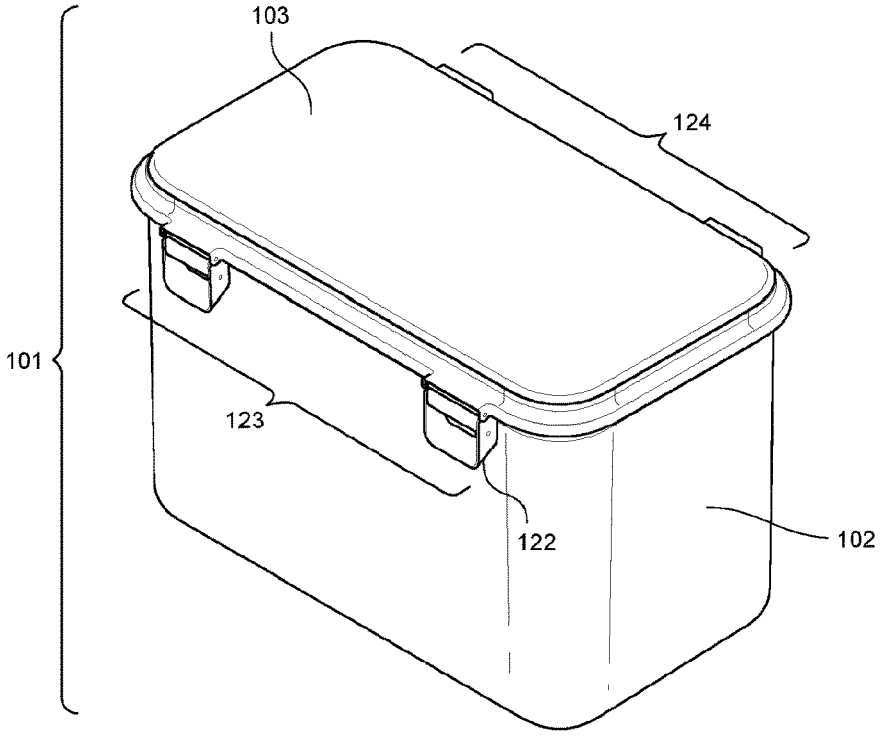
Figure 9:
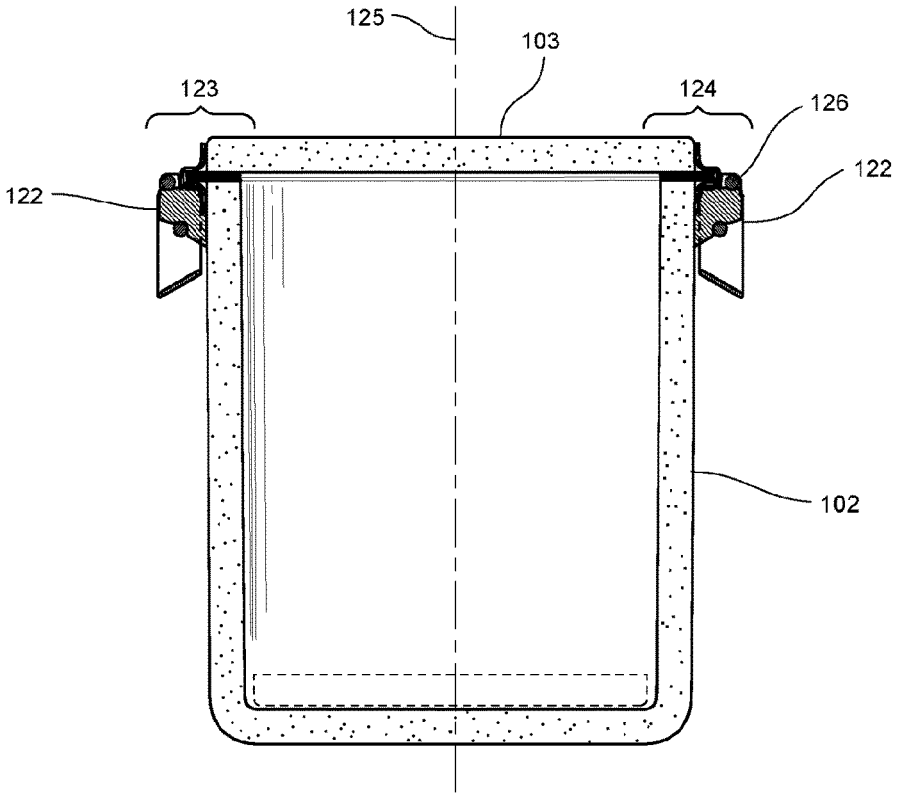
Figure 10A:
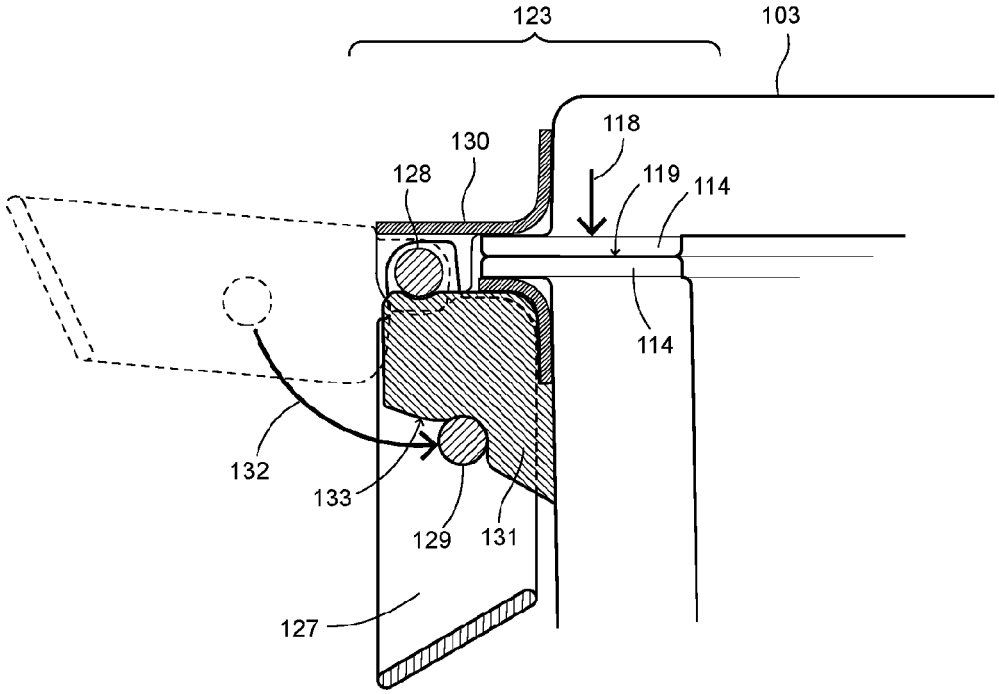
Figure 10B:
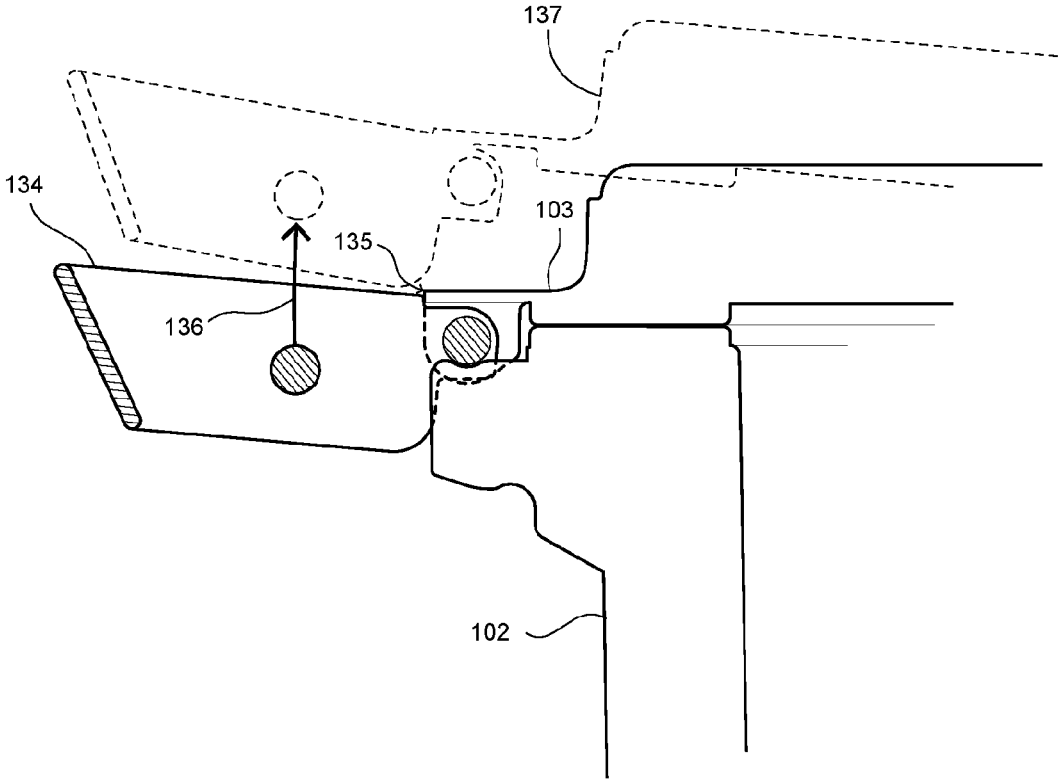
Figure 10C:
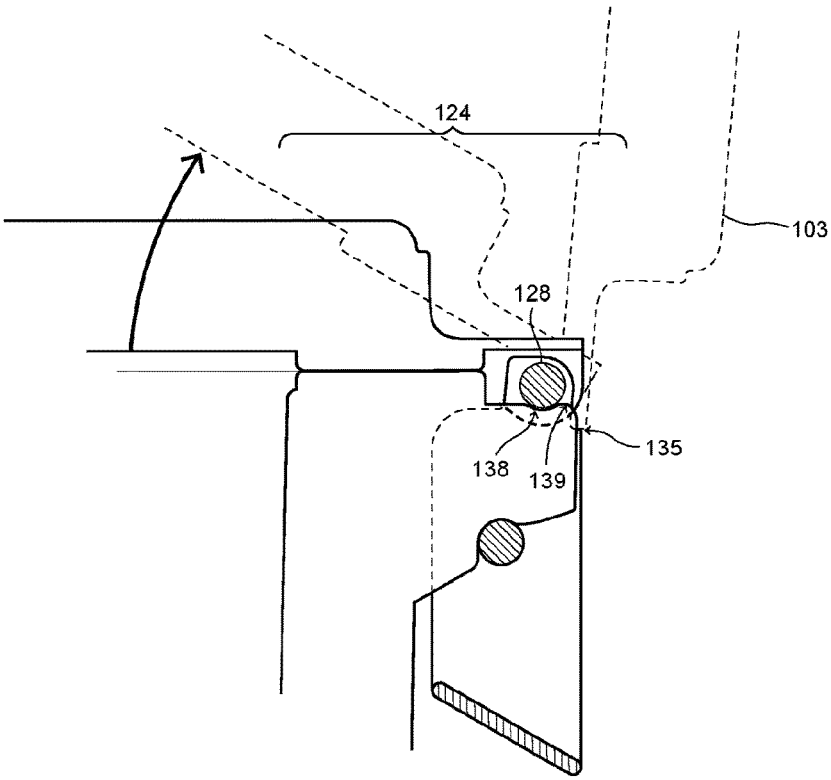
Figure 10D:
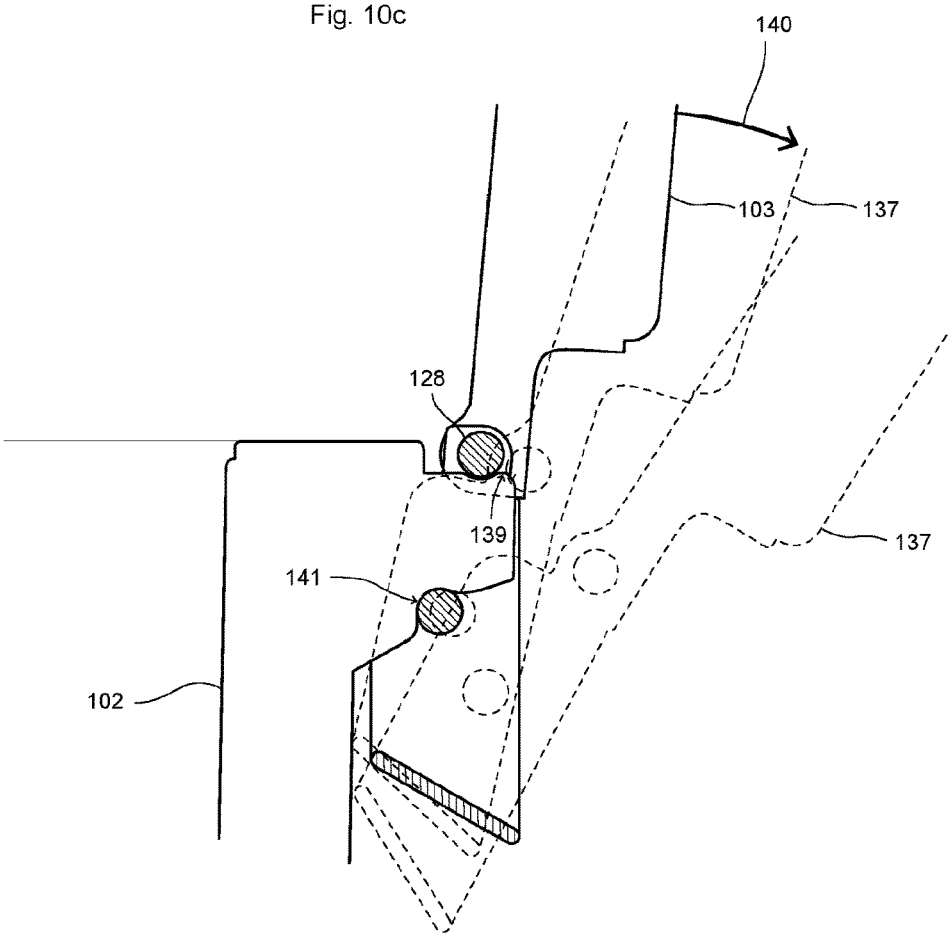
Figure 10E:
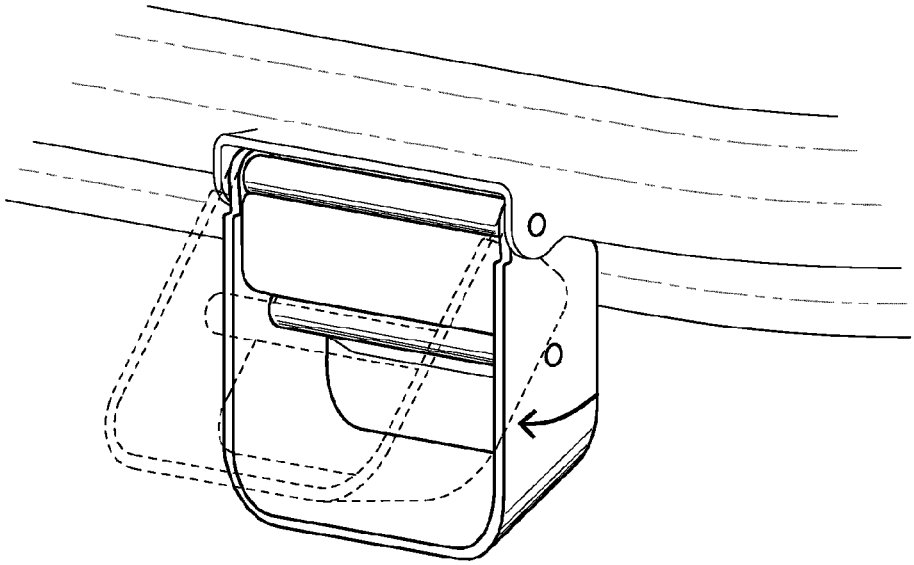
Figure 10F:
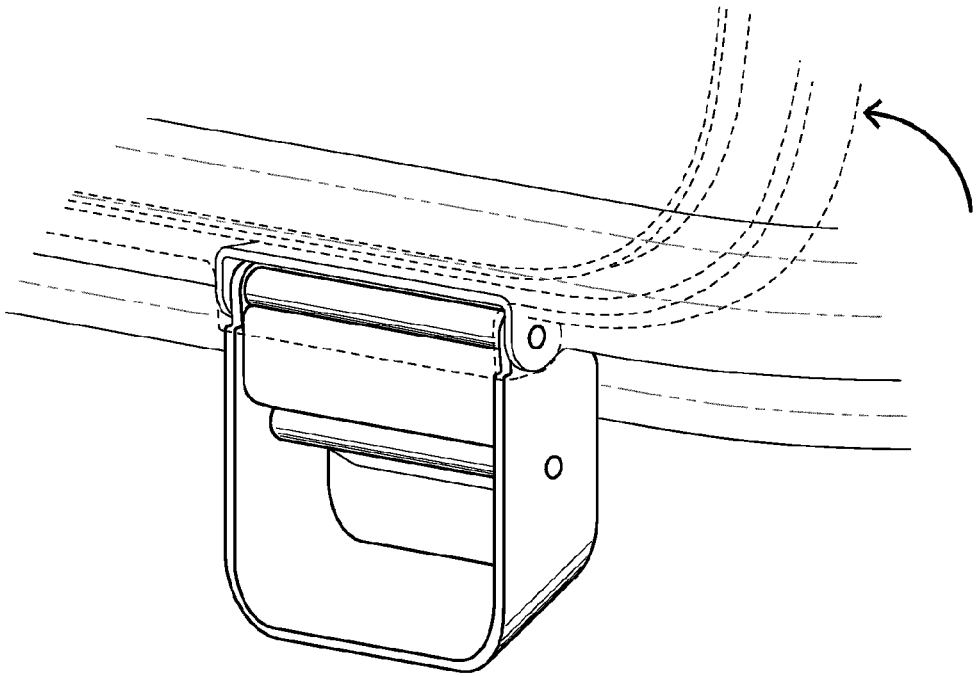

FIG. 7*b* shows a modification to the first embodiment with modified structural frame parts or shields;

FIG. 7*c* shows a modification to the first embodiment to provide a modified internal shell of a lid thereof;

FIG. 8 shows a second embodiment of a vacuum-insulated container comprising a body and a lid in a closed position;

FIG. 9 is a cross-section through the vacuum-insulated container of the second embodiment in the closed configuration;

FIGS. 10*a* and 10*b* are partial cross-sections showing a fastener of the vacuum-insulated container of the second embodiment in latched and unlatched configurations, respectively;

FIG. 10*c* is a partial cross-section showing hinge operation of a fastener of the vacuum-insulated container of the second embodiment;

FIG. 10*d* is a partial cross-section showing over-extension hinge operation of a fastener of the vacuum-insulated container of the second embodiment;

FIG. 10*e* is a perspective view showing latching operation of a fastener of the vacuum-insulated container of the second embodiment; and FIG. 10*f* is a perspective view showing hinge operation of a fastener of the vacuum-insulated container of the second embodiment.

FIGS. 1 to 7 illustrate a first embodiment of an insulated container 1.

Figure 1A:
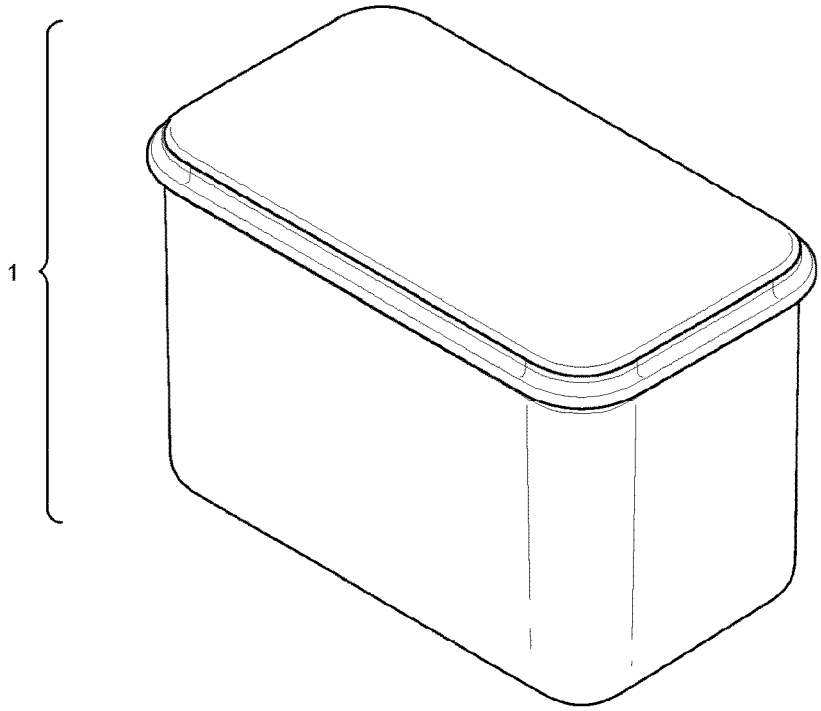
Figure 1B:
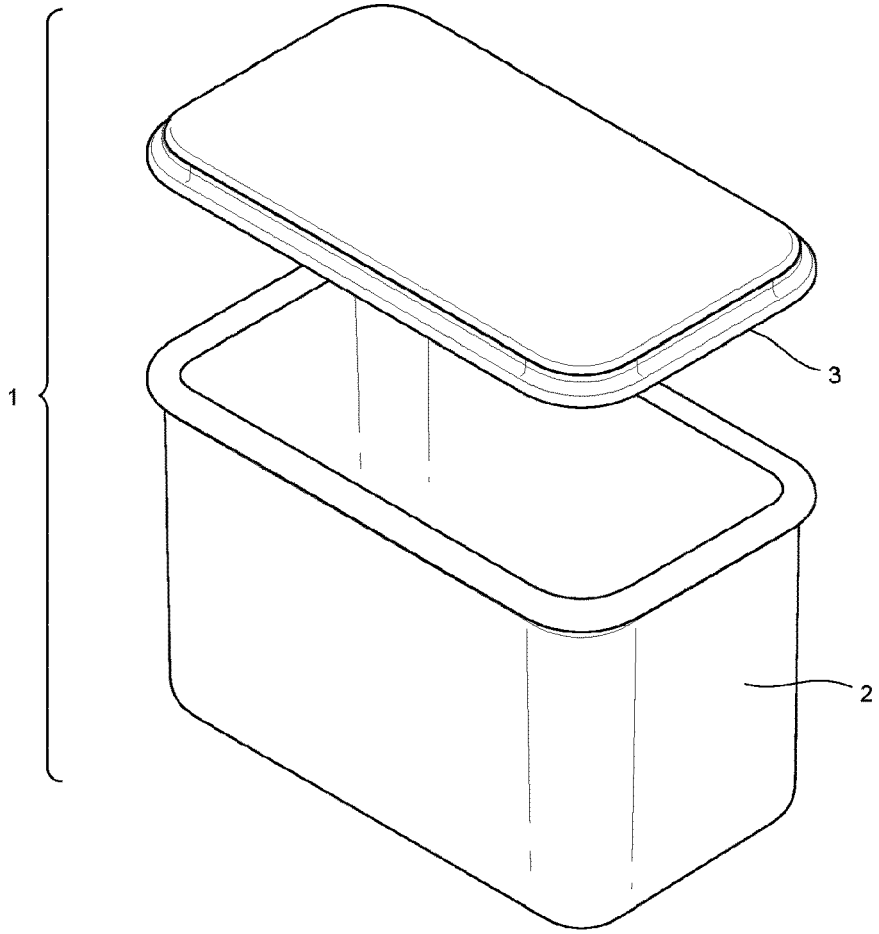
Figure 2:
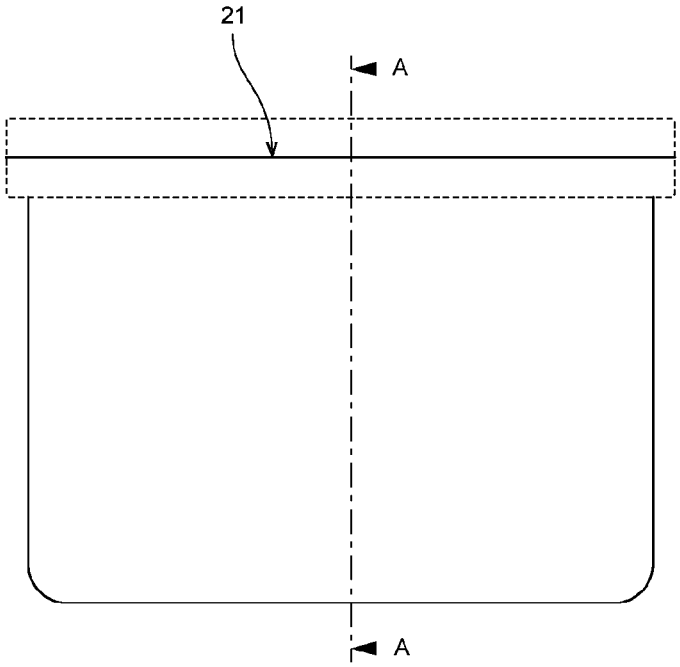
FIG. 2 shows a side view of the vacuum-insulated container of the first embodiment in the closed configuration highlighting an interface surface between the lid and the body.

FIGS. 1*a* and 1*b* show a body 2 and a lid 3 of the insulated container 1. The body 2 and the lid 3 fit together along an interfacing surface 21, shown in FIG. 2, by means of mechanical fastenings (not shown).

The primary function of the insulated container 1 is to maintain the temperature of an internal air volume 4 of the insulated container 1, together with any contents, for a period of time, independent of the temperature of the external ambient environment 5.

Figure 3:
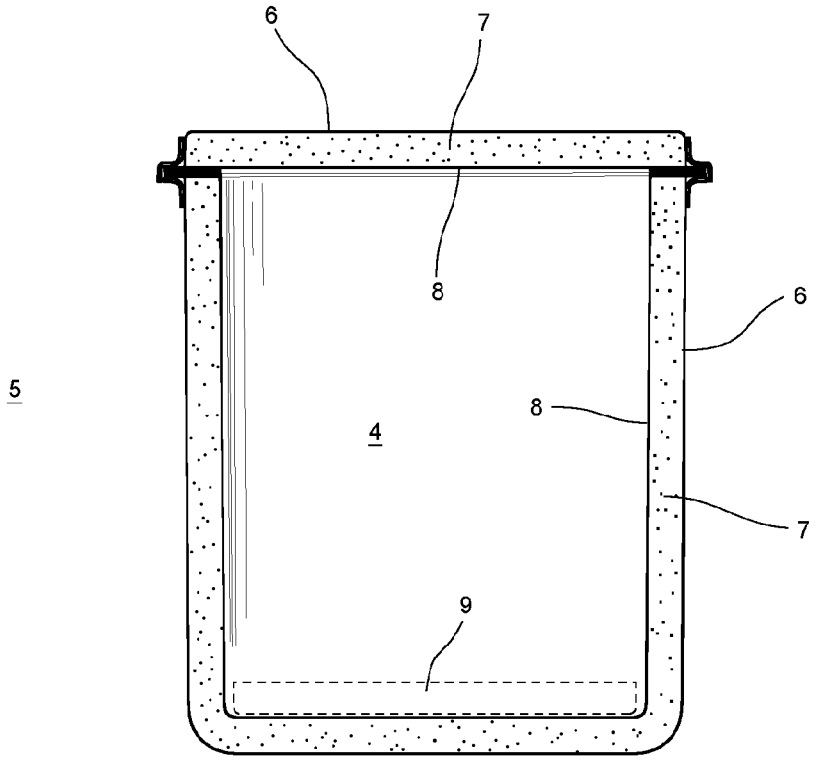
FIG. 3 is a cross-section through the vacuum-insulated container of the first embodiment in the closed position.

With reference to FIG. 3, the body 2 and lid 3 are both constructed with a multi-layered wall construction comprising an external shell 6, a core 7 and an internal shell 8.

The internal and external shells 6, 8 are made of thin, thermally-conductive aluminium. The internal and external shells 6, 8 have a thickness of approximately 0.6 mm, and contribute to the structural integrity of the container 1. The internal and external shells 6, 8 are manufactured by a deep drawing process, in which a sheet metal blank is radially drawn into a die by the mechanical action of a press.

The core 7 is constructed with a porous material that provides mechanical structure when the chamber construction is evacuated down to low pressure. In a preferred embodiment, fumed silica is used for the core 7.

The low pressure impedes heat transfer by means of conduction and convention. As well as providing stability to the shells 6, 8, the core 7 also restricts movement of the remaining gas molecules, further impeding heat transfer by convection.

An optional phase change material (PCM) module 9 may be added to the base of the internal air volume 4, which functions as a thermal energy bank. Direct contact between the PCM module 9 and the aluminium internal structural shell 8 provides fast transfer of thermal energy between the internal air volume 4 of the containers and the PCM module 9 by means of conduction along the aluminium internal shell 8 and subsequent convection into the internal air volume 4. This efficient energy transfer results in a more even temperature distribution within the internal air volume 4.

Figure 4:
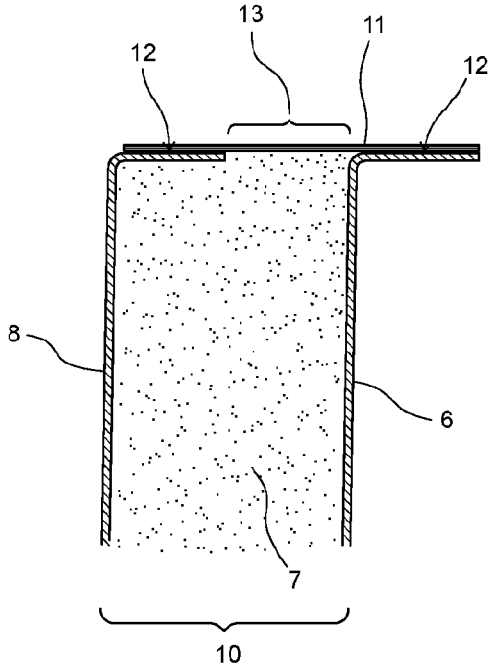
FIGS. 4 and 5 are partial cross-sections showing a seal of the body of the vacuum-insulated container of the first embodiment, with a gasket not shown and shown, respectively.

Referring now to FIG. 4, to create optimal insulation performance of an intermediate vacuum space 10 between the external structural shell 6 and the internal structural shell 8, the gasses within the porous structure of the insulation core 7 must be evacuated.

The internal and external shells 6, 8 and the core 7 are assembled at atmospheric pressure and a chamber seal 11 is bonded to the shells 6, 8 to form the intermediate vacuum space 10. The chamber seal 11 is bonded to the flanges using a pressure sensitive adhesive that is pre-applied to the chamber seal 11.

The intermediate vacuum space 10 is then evacuated to a target pressure through a small hole left in the chamber seal 11, which is then sealed after reaching the target pressure. Alternatively, however, the intermediate vacuum chamber 10 may be evacuated by applying the target pressure to the entire 'ring' opening 13 between the two flanges 12 prior to applying the chamber seal 11.

Typically, the intermediate vacuum space 10 is evacuated to approximately 1 mbar, as further pressure reduction below this point provides little additional insulating benefit due to thermal insulating bridging elsewhere in the insulated container 1.

The intermediate vacuum space 10 maintains the vacuum by means of the chamber seal 11 applied to horizontal flange surfaces 12 of the inner and outer structural shells 6, 8. The chamber seal 11 in this embodiment comprises a multilayer metallised film, which is composed of laminated layers of metal-coated polymer films, with the coating metal usually comprising aluminium. The chamber seal 11 minimises vapour and gas diffusion into the intermediate vacuum space 10 over the lifespan of the insulated container 1.

At the location of the horizontal flanges 12, the space between the outer and inner structural shells 6, 8, known as the thermal insulating bridge, directly affects the thermal insulating performance of the vacuum chamber. A wider bridge reduces heat transfer between the internal air volume 4 and the external ambient environment 5.

The surface area of the chamber seal 11 constitutes under 1% of the total surface area of the intermediate vacuum space 10, meaning that internal pressure change due to gas diffusion across the chamber seal 11 is greatly reduced compared to existing vacuum-insulated panels that are completely enclosed by multi-layer metallised foil.

Figure 5:
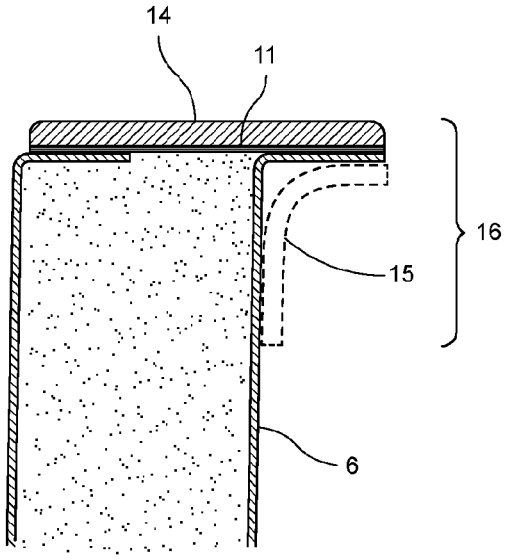

Referring now to FIG. 5, due to the fragility of multi-layer metallised foil, the entire surface of the chamber seal 11 is covered with a compressible gasket 14, which protects the multi-layer metalized foil of the chamber seal 11. The chamber seal 11 is substantially planar. The compressible gasket 14 is substantially planar. The chamber seal 11 and compressible gasket 14 of each shell engage one another substantially continuously all of the way between the flanges 12 of each shell at a substantially planar interface therebetween.

The chamber seal 11 is flexible. In this example the chamber seal 11 has a thickness of about 100 microns, although different thicknesses are contemplated. Within the multi-layer metallised foil, metal layers present are of aluminium although other materials are contemplated. The chamber seal 11 may include multiple individual layers of vapour/gas barrier, such as of aluminium, plus layers of other material such as polymer which may be incorporated e.g. for puncture protection, in one example the individual vapour/gas barrier layers each being less than 100 nanometres thick. The polymer layers may be laminated between barrier layers and vice versa.

In this example with at least one of the shells 6, 8 being an average of about 0.6 mm thick, the flexible chamber seal 11 is less than 20%, for example about 15 to 20%, of the thickness of at least one of the shells 6, 8.

Furthermore, the exposed flange edges of the external shell 6 may optionally be covered by a structural frame 15, fixed to the external shell 6 by means of an adhesive. This protects the structural integrity of the flange 12 and the chamber seal 11.

The chamber seal 11, the flanges 12, the gasket 14 and the structural frame 15 are collectively referred to as the vacuum seal 16. The general construction principles and geometry of the vacuum seal 16 may remain consistent over multiple embodiments of the design, though minor changes in geometry can be implemented depending on the container shape and other requirements.

Figure 6:
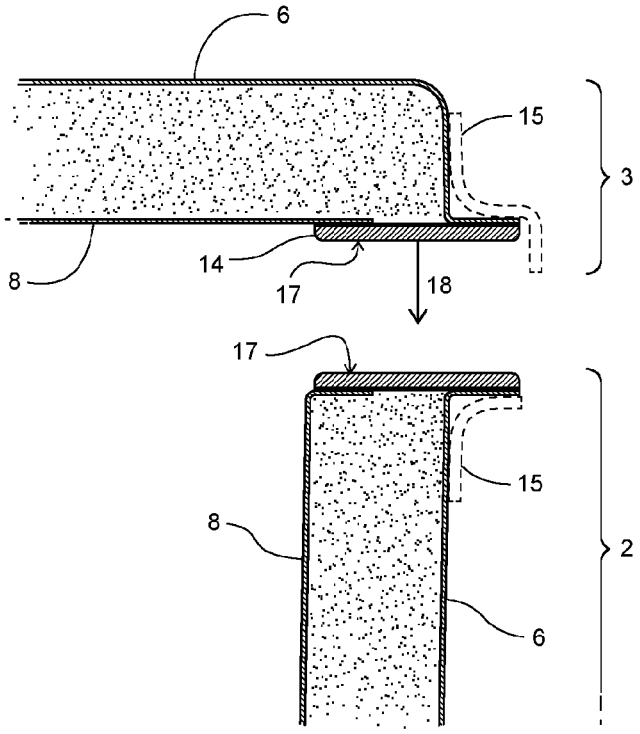
FIGS. 6 and 7 are detailed views of an interface between the lid and the body of the vacuum-insulated container of the first embodiment.

Referring now to FIG. 6, it can be seen that the overall shape of the inner and outer shells 6, 8 of the lid 3 and the body 2 are adjusted based on functional requirements of the lid 3 and the body 2, respectively. Furthermore, the lid 3 employs a vacuum seal 16 having a similar construction to the vacuum seal 16 of the body 2, except that the optional structural frame 15 has a slightly different shape, as will be discussed below.

In order to create a sealed internal air space 4, the lid 3 and body 2 are brought together so that the vacuum seals 16 of both the lid 3 and the body 2 are aligned with one another. Sealing surfaces 17 of the compressible gaskets 14 meet when a mechanical downward force 18 is applied to the lid 3 pressing it onto the body 2.

FIG. 7 shows the lid 3 and the body 2 assembled together. The flexible natures of the gaskets 14 allow absorption of minor unevenness in the flange geometry, allowing the container to maintain an airtight seal 19.

The structural frame 15 of the lid 3 is optionally provided with a lip edge 20 located around the outer perimeter of the structural frame 15. The lip edge 20 extends vertically downwards past the flange 12 of the body 2, when the lid 3 and body 2 are assembled together. The lip edge 20 allows for alignment of the vacuum seals 16 of the lid 3 and body 2. The lip edge 2 further covers the airtight seal 18 from external physical access.

In a modification shown in FIG. 7*b*, the structural frame 15 of the lid 3 and the structural frame 15 of the body 2 may each overlap (a) fully with its respective gasket 14 in a direction normal (e.g. vertical) to a direction in which its respective gasket 14 extends (e.g. horizontal). Thus, good physical shielding protection for each gasket is assured.

Furthermore, the structural frames 15 of the lid 3 and body 2 may interest or overlap with one another in the up/down direction when the lid 3 is positioned above the body 2. In this case, lip edge 21 of the structural frame 15 of the body 2 may be nested within the lip edge of 20 of the structural frame 15 of the lid 3. This may assist, for example, in keeping falling rain, snow or other potential unwanted materials away from the gaskets 14 while also providing good physical protection for the gaskets 14 and chamber seals 11, also assisting advantageously in positioning the lid 3 on the body 2.

FIG. 7*b* also shows an optional downward extent portion 22 of the structural frame 15 of the body which may be optionally incorporated to provide additional support on the body 2 in the region of the gasket 14 and chamber seal 11. Thus, the structural frame 15 of the body 2 may have a greater vertical extent than that of the lid 3 in a configuration with the lid 3 placed above the body 2.

The optional structural frames 15 when present may run fully round or substantially fully round outer peripheries of the lid 3 and body 2.

FIG. 7*c* shows a modification of the first embodiment in which a locator means or member 23 is incorporated into the lid 3. The locator member 23 when present may be formed as a rib 23. The rib 23 may run fully or substantially fully around the lid 3 near a peripheral outer edge of the inner shell 8 thereof, and may extend from the inner shell 8 of the lid 3, being positioned so as to overlap with the inner shell 8 of the body 2, sitting close to or engaging with the same in order to assist in well positioning the lid 3 on the body 2. When the gaskets 14 of the lid 3 and body 2 have substantially the same cross section as one another at sealing interface surfaces thereof, this may therefore assist in placing the lid 3 on the body 2 in a desired engagement configuration thereof with a full engagement between the gaskets 14.

The structural frames 15 of FIGS. 7, 7*b* and 7*c* may instead be called shields or shield members. They serve well to perform a shielding function for the gaskets 14 and chamber seals 11.

FIGS. 8 to 10 illustrate a second embodiment of an insulated container 101.

The structure of the insulated container 101 of the second embodiment is similar to that of the insulated container 1 of the first embodiment and, in particular, may include similar flexible seals and gaskets and inner and outer shell parts with flanges in a common plane (for each of the body and lid). Accordingly, features that have already been described will not be described again, and only those features that differ from the first embodiment will be described. Features present in both embodiments are indicated in the second embodiment using the same reference number as the first embodiment, but incremented by 100.

FIG. 8 shows the insulated container 101 comprising a body 102 and a lid 103, where the lid 103 is fastened to the body 102 by means of an even number of fasteners 122. Fasteners 122 are placed on opposing sides of the insulated container 101 in equal numbers. In usage, the opposing sides of the container 101 represent a latch side 123 and a hinge side 124 and these sides are interchangeable. For the purpose of these drawings, the latch side 123 is shown on the left and the hinge side 124 is shown on the right.

Referring to FIG. 9, each fastener 122 is permanently mounted to the lid 103 and the fasteners 122 are identical for both the latch side 123 and the hinge side 124. The design of the insulated container 101 is laterally symmetrical about a centre line 125.

FIG. 10*a* shows how the fastener 122 functions when on the latch side 123. The fastener 122 comprises two pins mounted to a fastener body 127. The fastener 122 interfaces with a mount block 131 by means of two pins 128, 129 each providing a specific function. A hinge pin 128 provides an axis of rotation for the fastener 122 to rotate with respect to the lid 103. A lock pin 129 mechanically locks the position of the fastener 122 in relation to the mount block 131. The mount block 131 is constructed in a semi-flexible material allowing plastic deformation under high load without resulting in permanent deformation of the mount block 131.

The process of latching the fastener 122 involves applying a manual rotation force 132 to the fastener 122 in towards the mount block 131 by a user. When the lock pin 129 reaches the mount block 131, it engages a compression ramp surface 133 of the mount block 131 causing the fastener 122, and consequently the lid 103, to be pulled downwards applying a downwards compression force 118 from the manual rotation force 132 applied by the user. This downwards force 118 acts on the opposing gaskets 114 of the lid 103 and body 102. The compression force 118 results in a tight seal along the gasket interface surface 119.

FIG. 10*b* shows the fastener 122 in a fully opened position 134 when it has reached a predefined maximum angle of rotation in relation to the lid 103. In the present embodiment the maximum angle is slightly beyond 90 degrees (approximately 95 degrees) from the locked position. This maximum angle is controlled by a hard stop mechanical interface 135 between the fastener 122 and a stop 130 provided on the lid 103. In the present embodiment, the stop 130 is formed as part of the structural frame 115 of the lid 103. Additional upwards or rotational force 136 of the fastener 122 after it has reached the fully open position 134 will result in lifting of the entire lid 103 away from the body 102.

FIG. 10*c* depicts how the fastener 122 functions when on the hinge side 124. The hinge pin 128 rests in a hinge pin resting track 138. On the side of the insulated container 101 acting as the hinge side 124, the hinge pin resting track 138 provides support for the hinge pin 128 during normal rotation of the lid 103. When the lid 103 reaches the predetermined maximum angle of rotation, as shown in FIG. 10*d*, further rotation will be prevented by the rotational hard stop interface 135 between the fastener 122 and the stop 130.

Referring to FIG. 10*d*, in the event of the lid 103 being subject to excessive mechanical lateral force 140 once it has reached its maximum rotation angle, the hinge pin 128 will begin to apply pressure to a hinge pin break away compression edge 139 of the mounting block 131. When this pressure is sufficiently high, it will result in temporary, elastic deformation of this compression edge 139, allowing the lid 103 and fastener 122 to over-rotate and break away from the body 102 of the insulated container 101.

In this action, a lock pin stop surface 141 engages with the lock pin 129 to cause the fastener body 127 to act as a lever arm that concentrates the rotational forces at the hinge pin on the hinge pin break away compression edge 139.

The fastener 122 is therefore capable of acting as both a latch, as shown in FIG. 10*e*, or as a hinge as shown in FIG. 10*f*. This advantageously allows for the insulated container 101 to be hingedly opened from either side. Furthermore, the breakaway function of the fastener 122 prevents excessive opening force being applied to the fastener 122. This is important because excessive load could damage the flanges 112 of the outer shells 106, thereby risking damage to the chamber seal 111.

Whilst not shown in the figures, the containers 1, 101 of both the first and second embodiments described above may be provided with a handle or carrying strap to facilitate lifting of the container 1, 101.

The invention claimed is:

1. A vacuum-insulated container body, comprising:

an inner body shell and an outer body shell, wherein the inner body shell and the outer body shell are each made of a metal material;

a core provided between the inner body shell and the outer body shell; and a seal connecting the inner body shell and the outer body shell, wherein the inner body shell, the outer body shell and the seal define an intermediate space surrounding the core, the intermediate space being at a pressure below atmospheric pressure; and wherein each of the inner body shell and the outer body shell comprises a flange bonded to the seal, the seal comprising a metallised foil extending between the flanges.

2. The vacuum-insulated container body according to claim 1, wherein the flanges of the inner body shell and the outer body shell both being in a common plane.

3. The vacuum-insulated container body according to claim 1, wherein the inner body shell and the outer body shell are each made from aluminium or an aluminium alloy.

4. The vacuum-insulated container body according to claim 1, wherein the inner body shell and the outer body shell each have an average thickness of less than 1.5 mm.

5. The vacuum-insulated container body according to claim 1, wherein the inner body shell and the outer body shell have each been formed by a deep drawing process.

6. The vacuum-insulated container body according to claim 1, wherein the inner body shell and the outer body shell each comprises a base, and a wall extending from the base in a direction perpendicular to the base.

7. The vacuum-insulated container body according to claim 6, wherein the plane of the flanges is perpendicular to the direction in which the walls of the inner and outer body shells extend.

8. The vacuum-insulated container body according to claim 1, wherein the core comprises one of polystyrene foam, polyurethane foam, precipitated silica and fumed silica.

9. The vacuum-insulated container body according to claim 1, wherein the seal is formed from a multi-layer metallised foil.

10. The vacuum-insulated container body according to claim 1, wherein the seal has been cut from a sheet of material.

11. The vacuum-insulated container body according to claim 1, further comprising:

a gasket mounted to both of the flanges with the seal between the gasket and the flanges.

12. The vacuum-insulated container body according to claim 1, in which the seal is formed of flexible material.

13. The vacuum-insulated container body according to claim 1, wherein the seal is not formed of solid metal.

14. The vacuum-insulated container body according to claim 1, wherein the seal is formed as a layer less than 0.3 mm thick.

15. The vacuum-insulated container body according to claim 1, wherein the seal is formed as a multi-layer construction which includes multiple individual barriers layers, each individual barrier layer being 100 nanometres thick.

16. The vacuum-insulated container body according to claim 1, wherein the seal is formed as a layer less than 50% of a thickness of at least one of the inner and outer body shells.

17. The vacuum-insulated container body according to claim 1, wherein a shield is provided and associated with the outer shell for shielding the seal.

18. The vacuum-insulated container body according to claim 17, further comprising:

a gasket mounted to both of the flanges with the seal between the gasket and the flanges, wherein the shield runs around an outer periphery of the gasket to shield the gasket.

19. A vacuum-insulated container comprising:

a vacuum-insulated container body according to claim 1; and a vacuum-insulated container lid configured to engage the container body.

20. The vacuum-insulated container according to claim 19, wherein the vacuum-insulated container lid comprises:

an inner lid shell and an outer lid shell, wherein the inner lid shell and the outer lid shell are each made of a metal material;

a core provided between the inner lid shell and the outer lid shell; and a seal connecting the inner lid shell and the outer lid shell, wherein the inner lid shell, the outer lid shell and the seal define an intermediate space surrounding the core, the intermediate space being at a pressure below atmospheric pressure; and wherein each of the inner lid shell and the outer lid shell comprises a flange bonded to the seal, the flanges of the inner lid shell and the outer lid shell both being in a common plane.

21. The vacuum-insulated container according to claim 20, wherein the flanges of the vacuum-insulated container lid are configured to engage the flanges of the vacuum-insulated container body, this engagement being indirect via respective seals and further gaskets associated with the respective flanges.

22. The vacuum-insulated container according to claim 19, wherein the vacuum-insulated container lid comprises:

an inner lid shell and an outer lid shell, wherein the inner lid shell and the outer lid shell are each made of a metal material;

a core provided between the inner lid shell and the outer lid shell; and a seal connecting the inner lid shell and the outer lid shell, wherein the inner lid shell, the outer lid shell and the seal define an intermediate space surrounding the core, the intermediate space being at a pressure below atmospheric pressure; and wherein each of the inner lid shell and the outer lid shell comprises a flange bonded to the seal, the seal which connects the inner lid shell and outer lid shell being a flexible seal comprising a flexible material.

23. The vacuum-insulated container according to claim 19, wherein a shell of at least one of the vacuum-insulated container lid and the vacuum-insulated container body includes a positioner for assisting in positioning the vacuum-insulated container lid and vacuum-insulated container body relative to one another.

24. The vacuum-insulated container according to claim 19, wherein a shield is provided and associated with the outer shell for shielding the seal, wherein a lid shield is provided for shielding the seal of the vacuum-insulated container lid, the lid shield being at least partially interested or overlapped within the shield of the vacuum-insulated container body of the vacuum-insulated container.

* * * * *